US010446994B1

(12) United States Patent
Ren et al.

(10) Patent No.: US 10,446,994 B1
(45) Date of Patent: Oct. 15, 2019

(54) LIGHTING SYSTEM WITH CERAMIC SOCKET ARRANGEMENT

(71) Applicant: MJ Manufacturer Direct LLC, Newark, DE (US)

(72) Inventors: Richard Ren, Anshan (CN); Jenny Tran, Irvine, CA (US); Connie Tran, Irvine, CA (US)

( * ) Notice: Subject to any disclaimer, the term of this patent is extended or adjusted under 35 U.S.C. 154(b) by 0 days.

(21) Appl. No.: 16/102,734

(22) Filed: Aug. 14, 2018

(51) Int. Cl.

| | |
|---|---|
| ***H01R 33/22*** | (2006.01) |
| ***F21V 19/00*** | (2006.01) |
| ***F21V 7/22*** | (2018.01) |
| ***H01R 13/717*** | (2006.01) |

(52) U.S. Cl.
CPC ..... *H01R 33/22* (2013.01); *F21V 7/22* (2013.01); *F21V 19/0005* (2013.01); *H01R 13/717* (2013.01); *H01R 2201/00* (2013.01)

(58) Field of Classification Search
CPC ..... H01R 33/22; H01R 13/717; F21V 7/22; F21V 19/0005
See application file for complete search history.

(56) References Cited

U.S. PATENT DOCUMENTS

2009/0103331 A1* 4/2009 Pazula ..... H01R 33/94 362/649
2014/0063837 A1* 3/2014 Rowlette, Jr. ..... G02B 6/0008 362/555

* cited by examiner

*Primary Examiner* — Anne M Hines
(74) *Attorney, Agent, or Firm* — Tsz Lung Yeung

(57) ABSTRACT

A lighting system includes an electrical arrangement, a reflector housing and a ceramic socket arrangement. The ceramic socket arrangement includes at least one socket housing and at least one sliding connector received in the socket housing. The sliding connector includes a resilient terminal, a base configured from ceramic material and having an engagement track adapted for accommodating the electrical terminal of the illuminating element, and a sliding member configured from ceramic material and connected to the base in a slidably movable manner. The sliding member is arranged to slide between an unlocked position and a locked position. In the unlocked position, the sliding member is slid to expose the engagement track to an exterior of the sliding connector. In the locked position, the sliding member is slid and retained to cover the engagement track and to electrically connect the resilient terminal to the electrical terminal of the illuminating element.

25 Claims, 7 Drawing Sheets

LIGHTING SYSTEM WITH CERAMIC SOCKET ARRANGEMENT

BACKGROUND OF THE PRESENT INVENTION

Field of Invention

The present invention relates to lighting apparatus, and more particularly to a lighting system comprising a ceramic socket arrangement which is capable of minimizing the risk of safety hazard and maximizing structural integrity and convenience of the lighting system as a whole.

Description of Related Arts

A conventional lighting fixture, such as a high-voltage grow light, usually comprises a power box, a reflector housing having a rectangular cross-sectional shape, and an illuminating device mounted in the reflector housing for providing high-intensity and a wide spectrum of illumination toward a predetermined area. The power box usually comprises electrical components for providing power to and activating the illuminating device.

The lighting fixture usually comprises two electrical sockets provided on two ends of the reflector housing so that the illuminating device can be mounted on the reflector housing through the electrical sockets. The electrical sockets are electrically connected to the power box for acquiring power for the illuminating device.

There exist a number of disadvantages for the above-mentioned conventional lighting fixture. First, the lighting fixture is primarily used for providing high-intensity illumination for an extended period of time. As a result, when the illuminating device is turned on, the temperature of the illuminating device and the electrical sockets will rise very rapidly and will become very high. This obviously poses great safety issues.

This safety problem worsens when one realizes that the electrical sockets can only be manufactured by insulating materials, such as plastic material. While plastic material is a good electrical insulator, it cannot withstand high temperature caused by the operation of the illuminating device. On the other hand, the electrical sockets cannot be manufactured by metallic materials because doing so would substantially increase the risks of short circuit and electrical fire.

Second, for conventional lighting fixtures such as the one described above, it is very difficult and troublesome to mount the illuminating device in the reflector housing. It usually requires complicated procedures and may not be done in a short period of time. As a result, when a user needs to replace the illuminating device, he or she may not have the necessary skill and may even need to find somebody else to finish the task.

As a result, there is a need to develop a lighting system which is capable of minimizing the risk of safety hazard and maximizing structural integrity and convenience of the lighting system as a whole.

SUMMARY OF THE PRESENT INVENTION

Certain variations of the present invention provide a lighting system which is capable of minimizing the risk of safety hazard and maximizing structural integrity and convenience of the lighting system as a whole.

Certain variations of the present invention provide a lighting system comprising a sliding connector in which a base and a sliding member are made of ceramic material so that they may withstand high temperature but at the same time provide good electrical insulation.

Certain variations of the present invention provide a lighting system comprising a sliding connector, wherein a user may be able to replace an illuminating element by conveniently sliding the sliding member with respect to the base. No complicated mechanical tools or mounting procedure are required.

In one aspect of the present invention, it provides a lighting system, for use with an illuminating element having an electrical terminal, comprising:

an electrical arrangement which comprises an electrical housing having a receiving cavity, and a power assembly received in the electrical housing;

a reflector housing having an illuminating cavity for receiving the illuminating element, and a reflector opening for communicating the illuminating cavity with an exterior of the reflector housing; and a ceramic socket arrangement, which comprises:

at least one socket housing connected to the reflector housing; and at least one sliding connector received in the socket housing, the sliding connector comprising:

a resilient terminal;

a base configured from ceramic material, the base having an engagement track adapted for accommodating the electrical terminal of the illuminating element; and a sliding member configured from ceramic material and connected to the base in a slidably movable manner, wherein the resilient terminal is provided on the sliding member and electrically connected to the power assembly, the sliding member being arranged to slidably move between an unlocked position and a locked position, wherein in the unlocked position, the sliding member is slidably moved to expose the engagement track to an exterior of the sliding connector, wherein in the locked position, the sliding member is slidably moved and retained to cover the engagement track and to electrically connect the resilient terminal to the electrical terminal of the illuminating element.

Another aspect of the present invention provides a ceramic socket arrangement for a lighting system for use with an illuminating element having an electrical terminal, the ceramic socket arrangement comprising:

at least one socket housing connected to the reflector housing; and at least one sliding connector received in the socket housing, the sliding connector comprising:

a resilient terminal;

a base configured from ceramic material, the base having an engagement track adapted for accommodating the electrical terminal of the illuminating element; and a sliding member configured from ceramic material and connected to the base in a slidably movable manner, wherein the resilient terminal is provided on the sliding member and electrically connected to the power assembly, the sliding member being arranged to slidably move between an unlocked position and a locked position, wherein in the unlocked position, the sliding member is slidably moved to expose the engagement track to an exterior of the sliding connector, wherein in the locked position, the sliding member is slidably moved and retained to cover the engagement track and to electrically connect the resilient terminal to the electrical terminal of the illuminating element.

This summary presented above is provided merely to introduce certain concepts and not to identify any key or essential features of the claimed subject matter.

DETAILED DESCRIPTION OF THE PREFERRED EMBODIMENT

Figure 1:
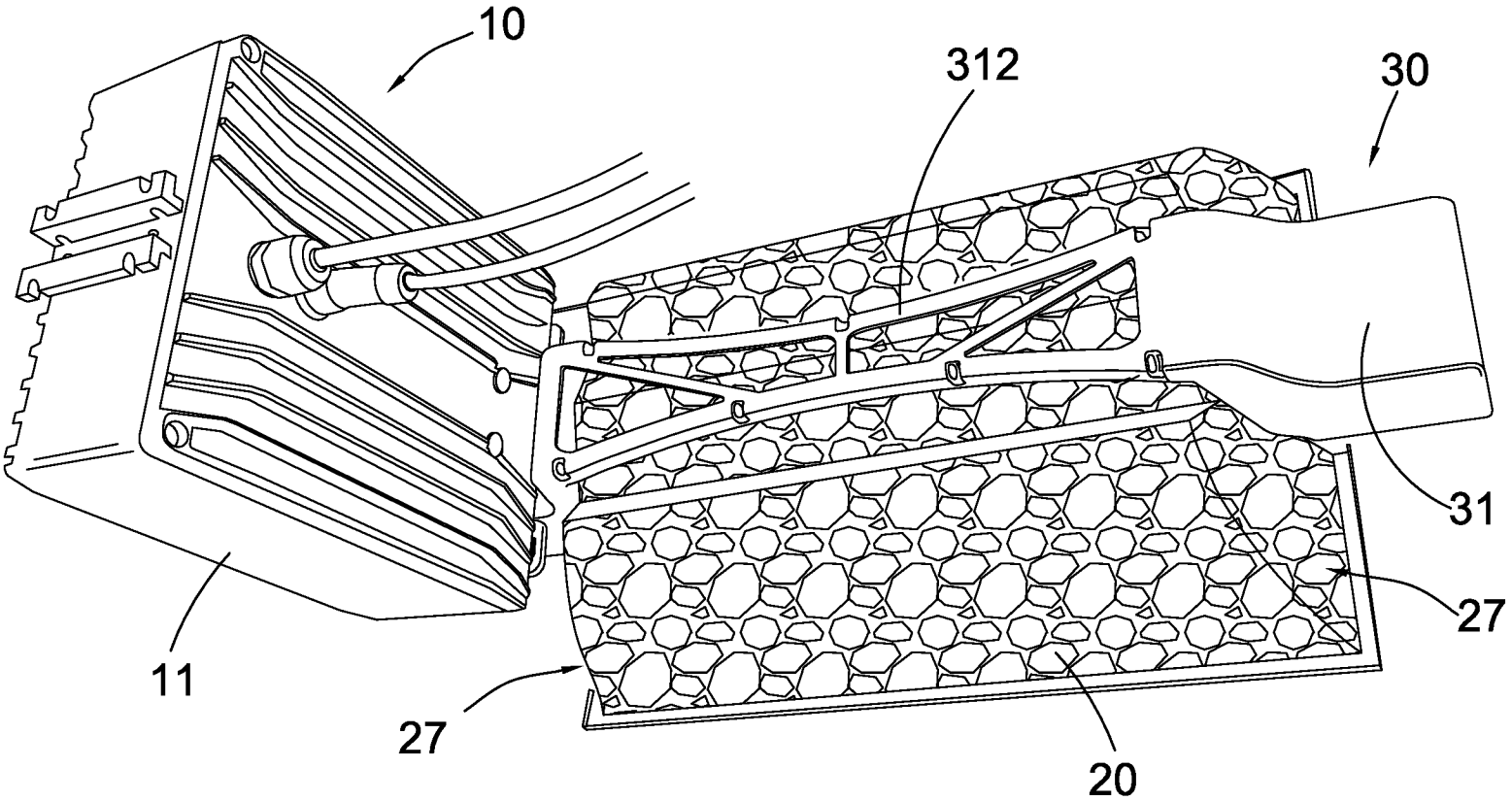
FIG. 1 is a perspective view of a lighting system according to a preferred embodiment of the present invention, illustrating a top side of the lighting system.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 9 of the drawings, a lighting system according a preferred embodiment of the present invention is illustrated. Broadly, the lighting system may comprise an electrical arrangement 10, a reflector housing 20, and a ceramic socket arrangement 30. The lighting system may be used in conjunction with an illuminating element 90 having an electrical terminal 91.

The electrical arrangement 10 may comprise an electrical housing 11 having a receiving cavity, and a power assembly 12 received in the electrical housing 11.

The reflector housing 20 may have an illuminating cavity 21 for receiving the illuminating element 90, and a reflector opening 22 for communicating the illuminating cavity 21 with an exterior of the reflector housing 20.

The ceramic socket arrangement 30 may comprise at least one socket housing 31 and at least one sliding connector 32. The socket housing 31 may be connected to the reflector housing 20.

The sliding connector 32 may be received in the socket housing 31, and may comprise a resilient terminal 33, a base 34 and a sliding member 35. The base 34 may be configured from ceramic material, and may have an engagement track 343 adapted for accommodating the electrical terminal 91 of the illuminating element 90.

The sliding member 35 may be configured from ceramic material and may be connected to the base 34 in a slidably movable manner, wherein the resilient terminal 33 is provided on the base 34 and electrically connected to the power assembly 12. The sliding member 35 may be arranged to slidably move between an unlocked position and a locked position, wherein in the unlocked position, the sliding member 35 may be slidably moved to expose the engagement track 343 to an exterior of the sliding connector 32, wherein in the locked position, the sliding member 35 may be slidably moved and retained to cover the engagement track 343 and to electrically connect the resilient terminal 33 to the electrical terminal 91 of the illuminating element 90.

According to the preferred embodiment of the present invention, the lighting system may be primarily designed for use with a high pressure illuminating element, such as a high pressure sodium vapor (HPS) lamp for grow light. A typical illuminating element 90, such as a HPS lamp, may comprise an elongated main arc tube 92 and a plurality of electrical terminals 91 extended from two ends of the main arc tube 92. The illuminating element 90 may be arranged to generate illumination in high intensity and power (usually in the range of 1000 W).

The electrical housing 11 of the electrical arrangement 10 may be configured from metallic material and may have a rectangular cross-sectional shape. The electrical housing 11 may be substantially sealed so as to protect the components received therein. The power assembly 12 may comprise an AC-DC converter 121 for converting AC power into DC power for use by the illuminating element 90. Thus, the power assembly 12 may be electrically connected to an external power source, such as an external AC power source.

Moreover, the lighting system may further comprise a ballast device 40 received in the electrical housing 11 and electrically connected to the electrical arrangement 10. The ballast device 40 may be arranged to provide proper starting and operating electrical condition for the illuminating element 90 which may be a high pressure sodium vapor (HPS) lamp.

The reflector housing 20 may be supported by the electrical housing 11 and may be arranged to receive the illuminating element 90. The reflector housing 20 may be configured from flexible and reflective material so as to reflect the illumination generated by the illuminating element 90. In this preferred embodiment, the reflector housing 20 may be made of aluminum and may have a plurality of reflective indentions 23 formed on an inner surface 24 (the inner surface facing the illuminating element 90) for enhancing a reflection capability of the reflector housing 20.

The reflector housing 20 may be shaped and sized to have an elongated structure and may have a generally rectangular cross-sectional shape. The illuminating cavity 21 may be sized and shaped to accommodate the illuminating element 90. Thus, a longitudinal length of the reflector housing 20 may be substantially the same as that of the main arc tube 92 of the illuminating element 90.

Moreover, the reflector housing 20 may further have a plurality of protrusions 25 formed on the inner surface 24 for further enhancing a reflective capability of the reflector housing 20. Each protrusion 25 may have two inclined surfaces 251 to form a substantially triangular cross-sectional shape.

The reflector housing 20 may further have two through attachment slots 26 formed at two ends thereof respectively, wherein the illuminating cavity 21 may communicate with the ceramic socket arrangement 30 through the two through attachment slots 26. In practice, when the illuminating element 90 may be received in the illuminating cavity 21 and connected to the sliding connector 32 through the through attachment slots 26.

Figure 2:
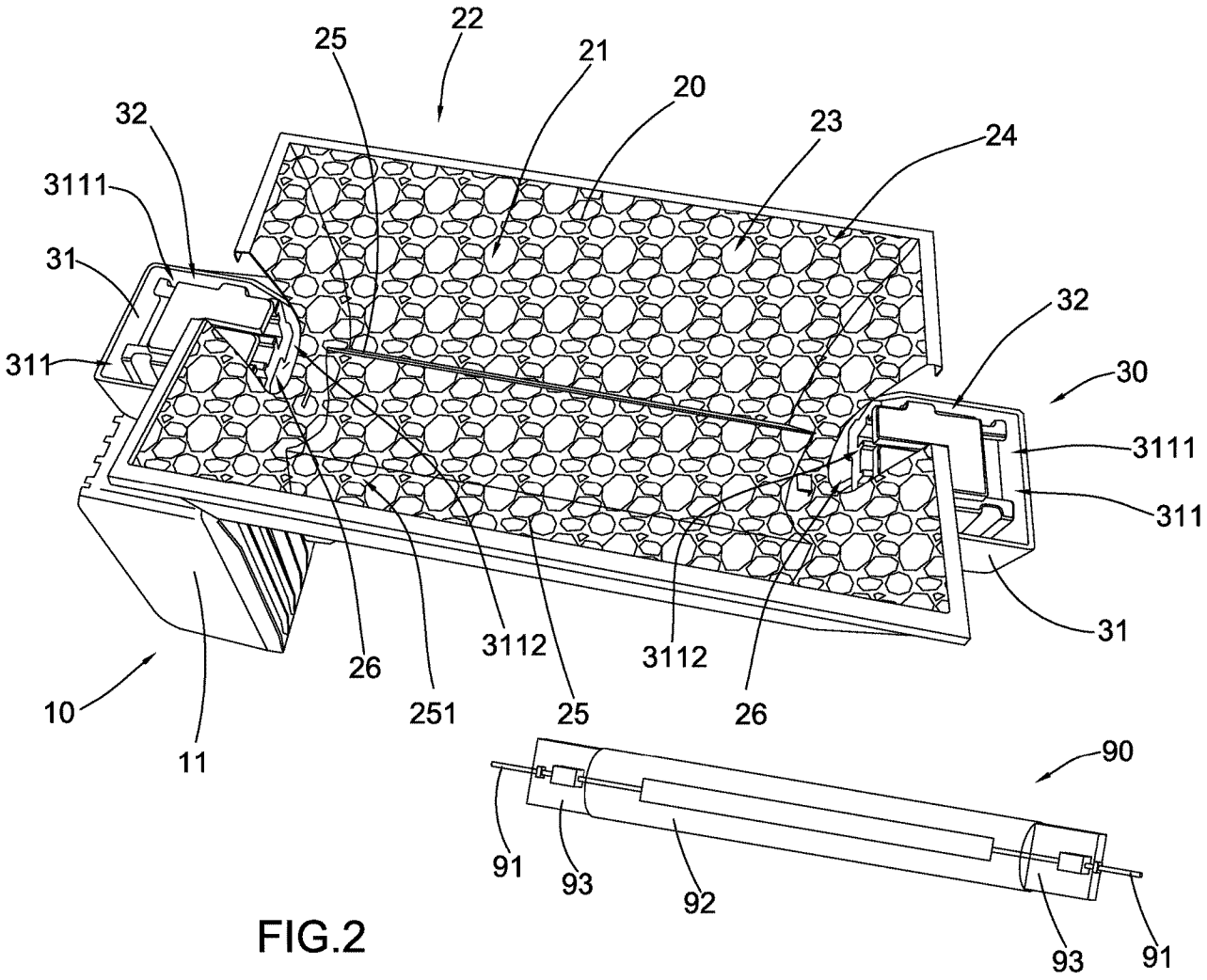
FIG. 2 is a perspective view of the lighting system according to the preferred embodiment of the present invention, illustrating a bottom side of the lighting system.

The socket housing 31 of the ceramic socket arrangement 30 may be mounted on the electrical housing 11 and extend along a longitudinal direction of the reflector housing 20. According to the preferred embodiment of the present invention, the socket housing 31 may be mounted partially on top of the reflector housing 20 for supporting the sliding connector 32. As shown in FIG. 1 and FIG. 2 of the drawings, the socket housing 31 may comprise two accommodating compartments 311 provided on two outer ends 27 of the reflector housing 20 respectively, and an extension frame 312 extended between the two accommodating compartments 311 on top of the reflector housing 20. Thus, each of the accommodating compartments 311 may be positioned corresponding to the corresponding through attachment slot 26 such that the accommodating compartments 311 may communicate with the illuminating cavity 21 through the through attachment slots 26 respectively.

Thus, each of the accommodating compartments 311 may have a bottom opening 3111 and a side opening 3112 facing toward the corresponding through attachment slot 26 of the reflector housing 20. One of the accommodating compartments 311 may be provided underneath the electrical housing 11, while the remaining accommodating compartment 311 may be provided on the other outer end 27 of the reflector housing 20. The extension frame 312 may reinforce and protect the reflector housing 20 which may be made by relatively lighter and thinner and more flexible material.

On the other hand, the ceramic socket arrangement 30 may comprise altogether two sliding connectors 32 received in the accommodating compartments 311 of the socket housing 31 respectively. In this preferred embodiment, each of the sliding connectors 32 may be structurally identical.

Thus, each of the sliding connectors 32 may comprise the resilient terminal 33, the base 34 and the sliding member 35 as described above. Moreover, the base 34 may be mounted in the corresponding accommodating compartment 311 for communicating with the corresponding electrical terminal 91 of the illuminating element 90.

The base 34 may be configured from ceramic material so that it may withstand high temperature and prevent it from being melted or damaged by the high temperature generated by the operation of the illuminating element 90. The base 34 may comprise a plurality of sidewalls 347 and may have a sliding portion 341 and a connecting portion 342, wherein the engagement track 343 may be formed on the connecting portion 342. Moreover, each of the bases 34 may further comprise a plurality of elastic members 36 mounted on the connecting portion 342 of the base 34. The elastic members 36 may be provided on two sides of the engagement track 343 respectively. The elastic members 36 may have a predetermined elasticity and may be utilized for biasing against the illuminating element 90.

Figure 4:
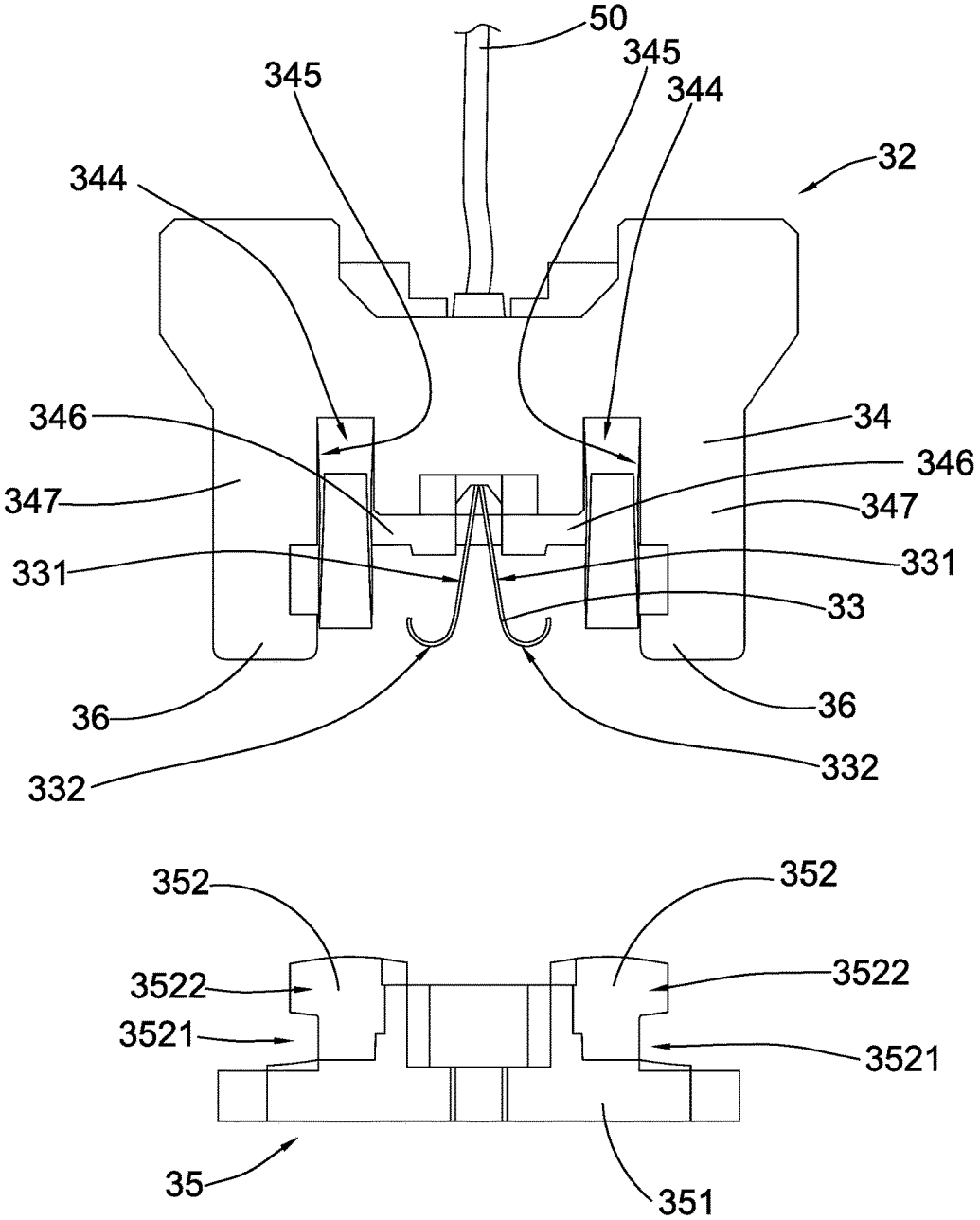
FIG. 4 is a front schematic view of the sliding connector according to the preferred embodiment of the present invention.

As shown in FIG. 4 of the drawings, the base 34 may further have a plurality of receiving grooves 344 formed on two sides of the engagement track 343 so that each of the receiving grooves 344 may be bounded by a corresponding inner surface 345 of the corresponding sidewall 347 and a corresponding side boundary 346 of the engagement track 343. The elastic elements 36 may be received in the receiving grooves 344 respectively. In this preferred embodiment, a ceiling of each of the receiving grooves 344 may be at an elevated position with respect to the ceiling of the engagement track 343.

On the other hand, the base 34 may further comprise a plurality of sliding grooves 348 formed along the inner surfaces 345 of the sidewalls 347 respectively for slidably engaging with the sliding member 35. The sliding grooves 348 may extend along a longitudinal direction of the base 34 when viewed from the top or from the bottom to define two securing portions 340 as the lower boundary of the sliding grooves 348 respectively.

Figure 3:
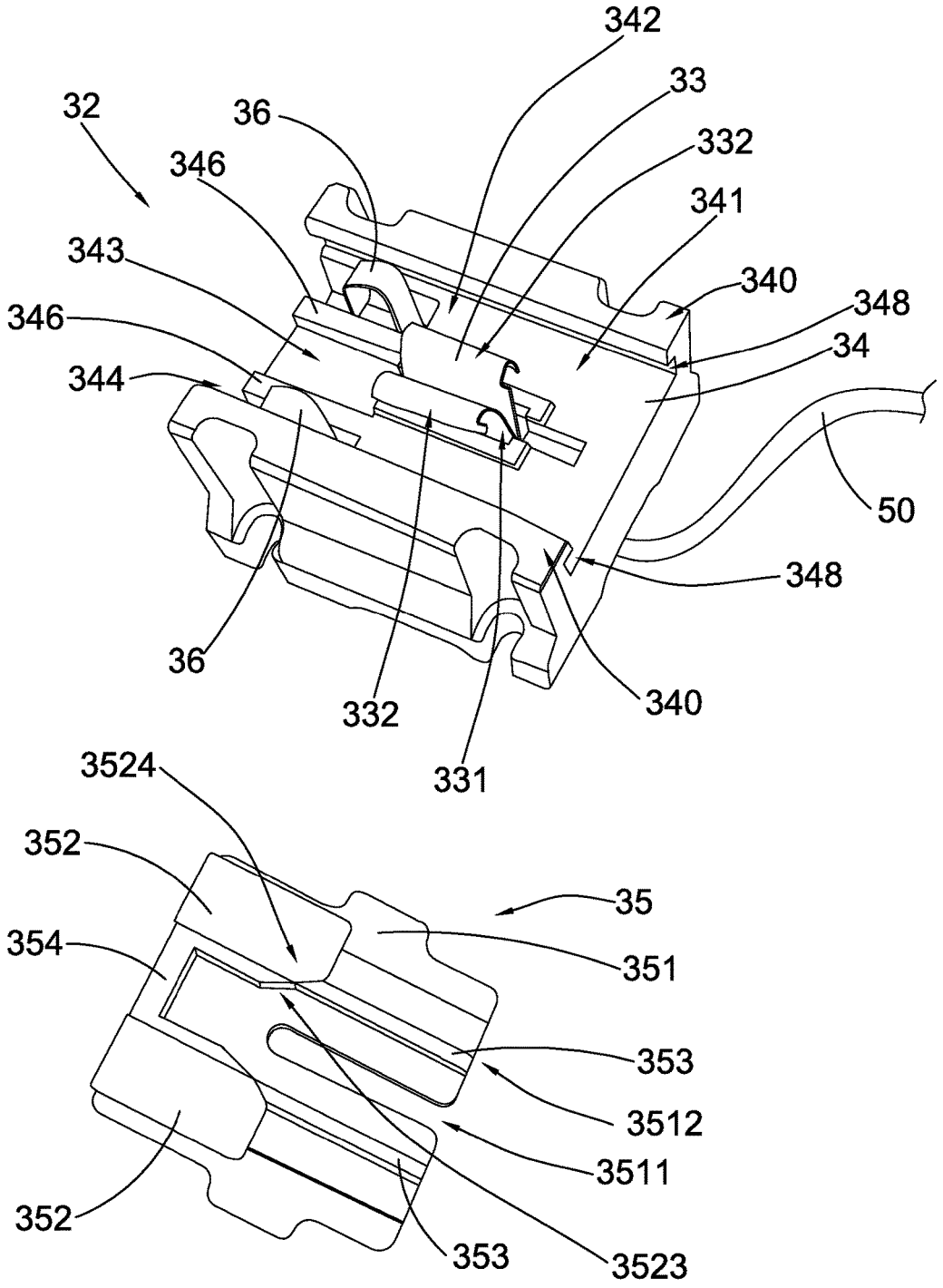
FIG. 3 is perspective view of a sliding connector according to the preferred embodiment of the present invention.

The base 34 may further comprise a plurality of resilient terminals 33 provided on the sliding portion 341, wherein each of the resilient terminals 33 may downwardly extend from the sliding portion 341 to operatively engage with the sliding member 35. As shown in FIG. 3 to FIG. 4 of the drawings, each of the resilient terminals 33 may comprise a thin metallic sheet folded to form a main resilient portion 331 and a curved engagement portion 332 extended from the main resilient portion 331 to engage with the sliding member 35. The resilient terminals 33 may be electrically connected to the electrical arrangement 10 through an electrical wire 50.

The main resilient portion 331 may be configured as a flat metallic sheet while the curved engagement portion 332 may outwardly extend from a bottom edge of the main resilient portion 331. Each of the curved engagement portions 332 may have a curved contour to form a substantially U-shaped cross section. The main resilient portions 331 of the resilient terminals 33 may be inclinedly extend from the sliding portion 341 of the base 34 in an outward direction so that each of the resilient terminals 33 may extend from the sliding portion 341 toward the corresponding sidewall 347 of the base 34. As such, the resilient terminals 33 may pivotally move with respect to the sliding portion 341 due to the resilient nature of the flat metallic sheet. When the resilient terminals 33 pivotally move with respect to the sliding portion 341, the curved engagement portions 332 may also move along a transverse direction of the base 34 (i.e. toward and away from the sidewalls 347).

The sliding member 35 may also be configured from ceramic material so that it may withstand high temperature and prevent from being melted or damaged by the high temperature generated by the operation of the illuminating element 90. Specifically, the sliding member 35 may comprise a slider plate 351, a plurality of coupling members 352 downwardly extended from the slider plate 351, and a plurality of guiding members 353 also upwardly extended from the slider plate 351 at positions in front of the coupling members 351 respectively.

The slider plate 351 may be configured as having a substantially rectangular cross-sectional shape which corresponds to a cross-sectional shape of the base 34. The slider plate 351 may have a through mounting groove 3511 extended from a front edge 3512 thereof.

The coupling members 352 may extend from two side edge portions of the sliding plate 351. Each of the coupling members 352 may have a coupling groove 3521 indently formed from an outer side surface of the corresponding coupling member 352 so as to form a coupling portion 3522 as an upper boundary of the coupling groove 3521. The coupling member 352 may be arranged to slidably engage with the base 34 in such a manner that the coupling portion 3522 may be fittedly and slidably inserted into the corresponding sliding groove 348 while the securing portions 340 of the base 34 may be fittedly and slidably inserted into the coupling grooves 3521 respectively. Thus, the coupling members 352 and the base 34 may slidably engage with each other.

Each of the coupling members 352 may further have an inclined surface 3523 formed on a front portion 3524 thereof so that a perpendicular distance between the two coupling members 352 may gradually increase from rear to the front of the front portions 3524 of the coupling members 352, as shown in FIG. 3 of the drawings.

The sliding member 35 may further comprise a biasing member 354 downwardly extended from the slider plate 351 at a position between the coupling members 352 for restriction a further forward movement of the slider plate 351. The biasing member 354 may transversely extend between the two coupling members 352 at a rear portion thereof so that when the sliding member 35 slides along a longitudinal direction of the base 34, the biasing member 354 may eventually hit the resilient terminals 33 which can only pivotally move along a transverse direction of the base 34. Thus, the biasing member 354 may be stopped by the resilient terminals 33 and therefore the sliding member 35 may be prevented from further sliding frontwardly (i.e. in the direction of the illuminating element 90) with respect to the base 34.

The guiding members 353 may extend from the front portions 3524 of the coupling members 352 toward the front edge 3512 of the slider plate 351. It is worth mentioning that a perpendicular distance between the two guiding members 353 may gradually decrease from the front portions 3524 of the coupling members 352 toward the front edge 3512 of the slider plate 351. In other words, the two guiding members 352 may not be parallel with each other.

On the other hand, the mounting groove 3511 may be formed between the two guiding members 353 so that two side edges of the mounting groove 3511 may roughly follow the contour of the guiding members 353. A width of the mounting groove 3511 of the slider plate 351 may gradually increase from the front edge 3512 thereof to an opposed end of the mounting groove 3511.

The operation of the present invention is as follows: the sliding connectors 35 may be utilized to mount the illuminating element 90 in the illuminating cavity 21 of the reflector housing 20. The illuminating element 90 may further comprise a plurality of insulating supporters 93 formed on two ends of the main arc tube 92 respectively. The illuminating element 90 may have two electrical terminals 91 configured as elongated metallic wires extended from the insulating supporters 93 respectively.

The electrical terminals 91 and the insulating supporters 93 may be arranged to couple with the two sliding connectors 32 respectively. The electrical terminal 91 may be arranged to insert into a space between the two resilient terminals 33 of the corresponding base 34 while the insulating supporters 93 may be arranged to bias against the elastic elements 36. After that, the sliding plate 351 of the sliding member 35 may slidably engage with the base 34 so that the coupling members 352 may slide in the sliding grooves 348 in the manner described above.

Figure 5:
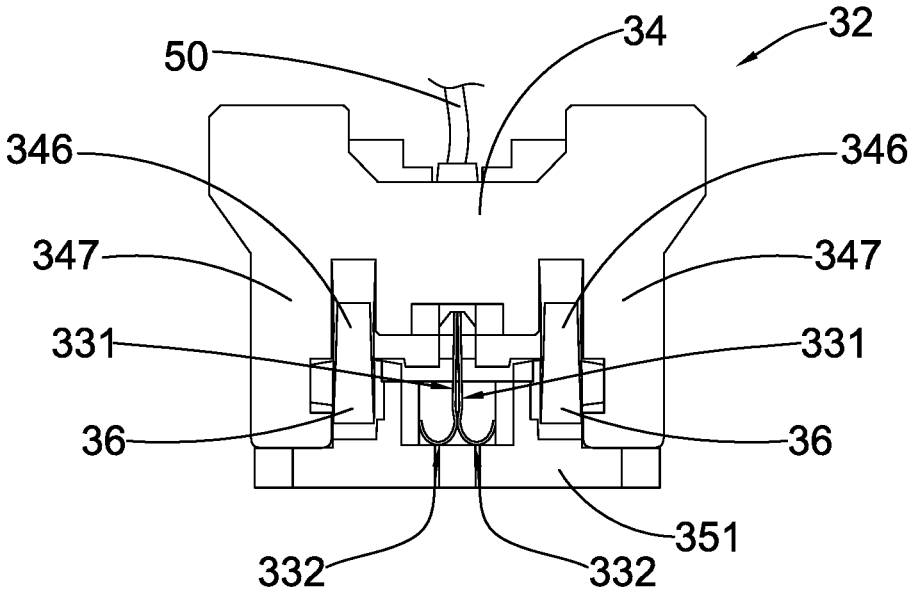
FIG. 5 is a schematic diagram of the sliding connector according to the preferred embodiment of the present invention, illustrating that the sliding member is in the unlocked position.
Figure 7:
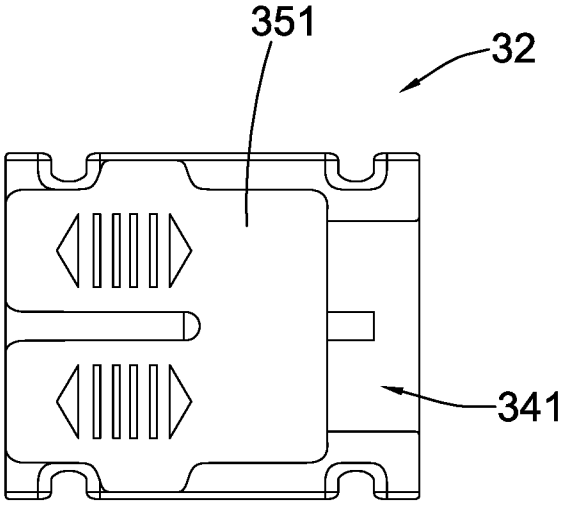
FIG. 7 is another schematic diagram of the sliding connector according to the preferred embodiment of the present invention, illustrating that the sliding member is in the unlocked position.
Figure 9:
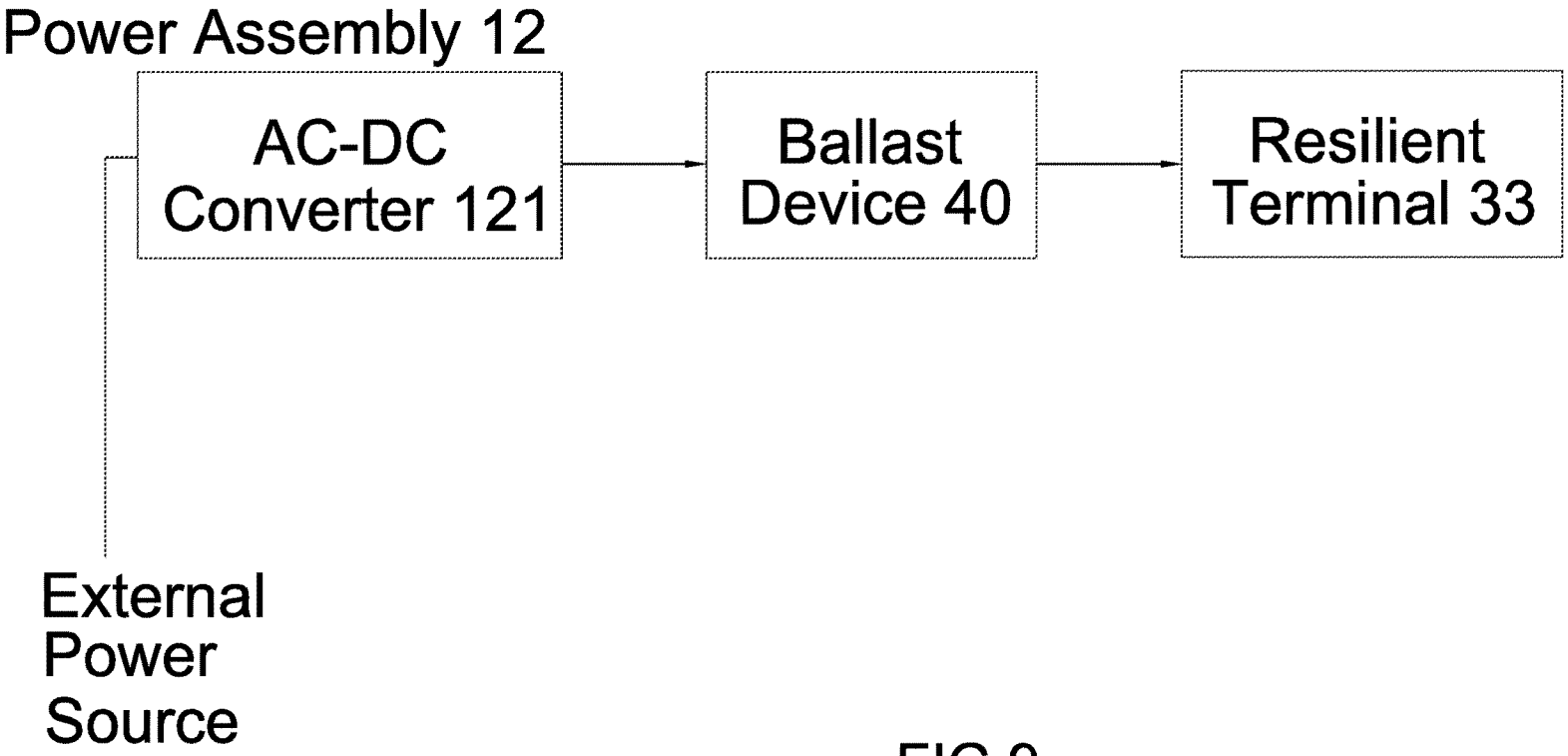
FIG. 9 is block diagram of an electrical arrangement according to the preferred embodiment of the present invention.

Referring to FIG. 3, FIG. 5 and FIG. 7 of the drawings, in the unlocked position, the resilient terminals 33 may rest in the space formed between the two guiding members 353 so that the electrical terminal 91 may loosely rest between the resilient terminals 33. At the same time, the connecting portion 342 of the base 34 may expose to ambient environment so that a user of the present invention may easily remove and insert the electrical terminal 91 from and to the resilient terminals 33.

Figure 6:
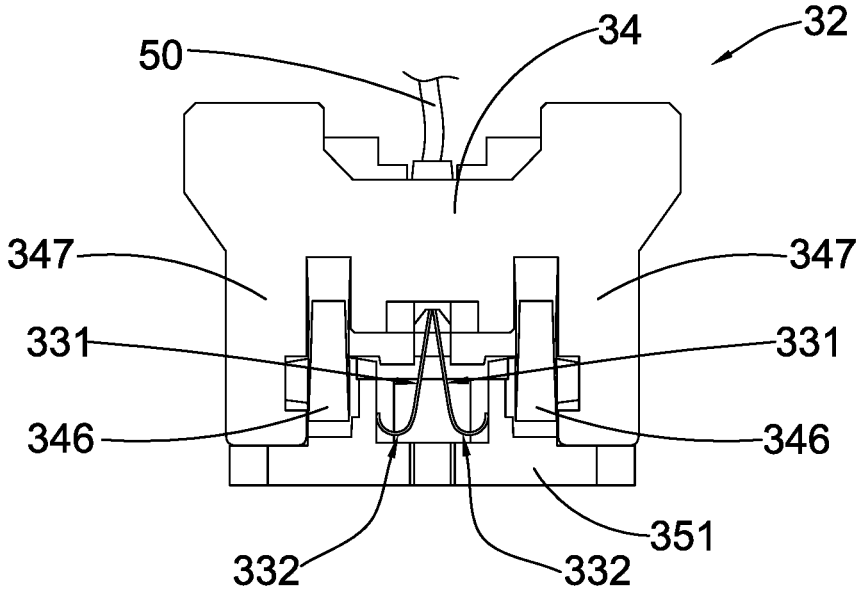
FIG. 6 is a schematic diagram of the sliding connector according to the preferred embodiment of the present invention, illustrating that the sliding member is in the locked position.
Figure 8:
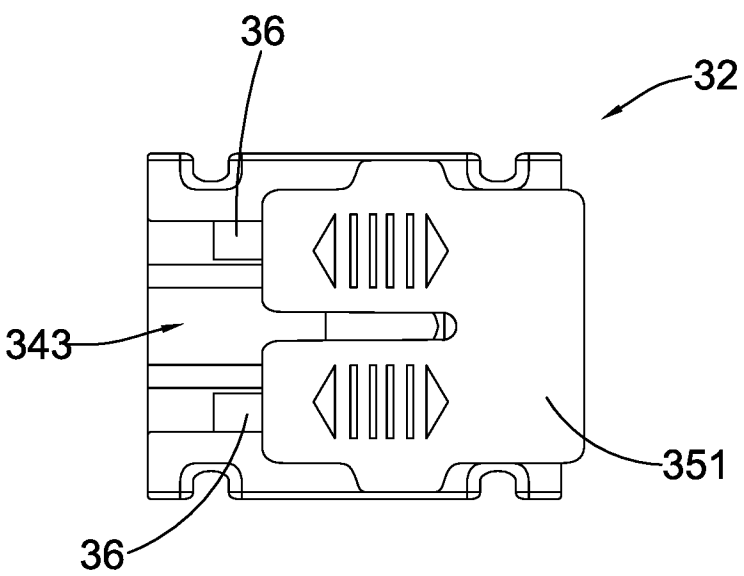
FIG. 8 is another schematic diagram of the sliding connector according to the preferred embodiment of the present invention, illustrating that the sliding member is in the locked position.

As shown in FIG. 6 and FIG. 8 of the drawings, to lock the illuminating element 91, the sliding member 35 may slide toward the reflector housing 20 so that the curved engagement portions 332 of the resilient terminals 33 may be forced to accommodate in the space between the two coupling members 352. Since a width of between the two coupling members 352 is smaller than that of the width between the guiding members 353 due to the existence of the inclined surfaces 3523, the curved engagement portions 332 may therefore be forced to fittedly accommodate in the in the space between the two coupling members 352 and to tightly bias against the corresponding electrical terminal 91. The sliding member 35 may further be slid until the biasing member 354 reach the resilient terminals 33. At that point, the biasing member 354 may bias against the resilient terminals 33 and any further movement of the sliding member 35 may be stopped. This is referred to as the locked position as mentioned above. When the illuminating element 90 is locked by in the reflector housing 90 by the sliding connectors 32, he may turn on the illuminating element 90 for providing illumination to a predetermined area.

When the user wishes to unlock the illuminating element 90, he may simply slide the sliding members 35 away from the reflector housing 20 so as to allow the curved engagement portions 332 to move back to the space between the corresponding guiding members 353. After that, the biasing force exerted to the electrical terminal 91 by the corresponding resilient terminals 33 may be released. At the same time, the connecting portion 342 of the base 34 may be exposed to ambient environment and the user may manually take out the electrical terminal 91 in a very easy manner.

From the forgoing descriptions, one skilled in the art may appreciate that the sliding connectors 35 of the present invention may provide a convenient and easy way for allowing a user to mount and replace the illuminating element 90 to and from the reflector housing 20. Moreover, since the base 34 and the sliding member 35 are made of ceramic material, they may withstand high temperature (arising from the operation of the illuminating element 90) without melting. As a result, the risk of having electrical fire can be minimized as compared to conventional lighting systems.

The present invention, while illustrated and described in terms of a preferred embodiment and several alternatives, is not limited to the particular description contained in this specification. Additional alternative or equivalent components could also be used to practice the present invention.

What is claimed is:

1. A lighting system for use with an illuminating element having an electrical terminal, comprising:

an electrical arrangement which comprises an electrical housing having a receiving cavity, and a power assembly received in said electrical housing;

a reflector housing having an illuminating cavity for receiving said illuminating element, and a reflector opening for communicating said illuminating cavity with an exterior of said reflector housing; and a ceramic socket arrangement, which comprises:

at least one socket housing connected to said reflector housing; and at least one sliding connector received in said socket housing, said sliding connector comprising:

a resilient terminal;

a base configured from ceramic material, said base having an engagement track adapted for accommodating said electrical terminal of said illuminating element; and a sliding member configured from ceramic material and connected to said base in a slidably movable manner, wherein said resilient terminal is provided on said sliding member and electrically connected to said power assembly, said sliding member being arranged to slidably move between an unlocked position and a locked position, wherein in said unlocked position, said sliding member is slidably moved to expose said engagement track to an exterior of said sliding connector, wherein in said locked position, said sliding member is slidably moved and retained to cover said engagement track and to electrically connect said resilient terminal to said electrical terminal of said illuminating element.

2. The lighting system, as recited in claim 1, wherein said base of said sliding connector further comprises a plurality of sidewalls and has a sliding portion and a connecting portion, wherein said engagement track is formed on said connecting portion said base may further comprising a plurality of elastic members mounted on said connecting portion of said base on two sides of said engagement track respectively, said elastic members having predetermined elasticity for biasing against said illuminating element.

3. The lighting system, as recited in claim 2, wherein said base further has a plurality of receiving grooves formed on two sides of said engagement track so that each of said receiving grooves is bounded by a corresponding inner surface of said corresponding sidewall and a corresponding side boundary of said engagement track, said elastic elements being received in said receiving grooves respectively.

4. The lighting system, as recited in claim 3, wherein said base further comprise a plurality of sliding grooves formed along said inner surfaces of said sidewalls respectively for slidably engaging with said sliding members, said sliding grooves extending along a longitudinal direction of said base to define two securing portions as a lower boundary of said sliding grooves respectively.

5. The lighting system, as recited in claim 4, wherein said base further comprises a plurality of resilient terminals provided on said sliding portion, wherein each of said resilient terminals downwardly extends from said sliding portion to operatively engage with said sliding member, each of said resilient terminals comprising a thin metallic sheet forming a main resilient portion and a curved engagement portion extended from said main resilient portion to engage with said sliding member, said resilient terminals electrically connecting to said electrical arrangement.

6. The lighting system, as recited in claim 5, wherein said curved engagement portion outwardly extends from a bottom edge of said main resilient portion, said main resilient portions of said resilient terminals inclinedly extending from said sliding portion of said base in an outward direction so that each of said resilient terminals extends from said sliding portion toward said corresponding sidewall of said base, such that when said resilient terminals pivotally move with respect to said sliding portion, said curved engagement portions move along a transverse direction of said base.

7. The lighting system, as recited in claim 6, wherein said sliding member comprises a slider plate, a plurality of coupling members downwardly extended from said slider plate, and a plurality of guiding members upwardly extended from said slider plate at positions in front of said coupling members respectively.

8. The lighting system, as recited in claim 7, wherein said coupling members extend from two side edge portions of said sliding plate, each of said coupling members having a coupling groove indently formed from an outer side surface of said corresponding coupling member so as to form a coupling portion as an upper boundary of said coupling groove, said coupling member being arranged to slidably engage with said base in such a manner that said coupling portion is arranged to fittedly and slidably insert into said corresponding sliding groove while said securing portions of said base are arranged to fittedly and slidably inserted into said coupling grooves respectively.

9. The lighting system, as recited in claim 8, wherein each of said coupling members further has an inclined surface formed on a front portion thereof so that a perpendicular distance between said two coupling members may gradually increase from rear to front with respect to said front portion of said coupling member.

10. The lighting system, as recited in claim 9, wherein said sliding member further comprises a biasing member downwardly extended from said slider plate at a position between said coupling members for restriction a further forward movement of said slider plate.

11. The lighting system, as recited in claim 10, wherein said guiding members extend from said front portions of said coupling members toward said front edge of said slider plate, a perpendicular distance between said two guiding members gradually decreasing from said front portions of said coupling members toward said front edge of said slider plate, so that when said sliding member is in said locked position, said curved engagement portions are arranged to be fittedly received in a space between said coupling members.

12. The lighting system, as recited in claim 11, wherein said reflector housing has two through attachment slots formed at two ends thereof respectively, wherein said illuminating cavity is arranged to communicate with said ceramic socket arrangement through said two through attachment slots.

13. The lighting system, as recited in claim 12, wherein said socket housing comprises two accommodating compartments provided on two outer ends of said reflector housing respectively, and an extension frame extended between said two accommodating compartments on top of said reflector housing, each of said accommodating compartments being positioned corresponding to said corresponding through attachment slot such that said accommodating compartments is capable of communicating with said illuminating cavity through said through attachment slots respectively.

14. The lighting system, as recited in claim 13, wherein said ceramic socket arrangement comprises two sliding connectors received in said accommodating compartments of said socket housing respectively, said two sliding connectors having identical structures.

15. A ceramic socket arrangement for a lighting system for use with an illuminating element having an electrical terminal, said ceramic socket arrangement comprising:

at least one socket housing connected to said reflector housing; and at least one sliding connector received in said socket housing, said sliding connector comprising:

a resilient terminal;

a base configured from ceramic material, said base having an engagement track adapted for accommodating said electrical terminal of said illuminating element; and a sliding member configured from ceramic material and connected to said base in a slidably movable manner, wherein said resilient terminal is provided on said sliding member and electrically connected to said power assembly, said sliding member being arranged to slidably move between an unlocked position and a locked position, wherein in said unlocked position, said sliding member is slidably moved to expose said engagement track to an exterior of said sliding connector, wherein in said locked position, said sliding member is slidably moved and retained to cover said engagement track and to electrically connect said resilient terminal to said electrical terminal of said illuminating element.

16. The ceramic socket arrangement, as recited in claim 15, wherein said base of said sliding connector further comprises a plurality of sidewalls and has a sliding portion and a connecting portion, wherein said engagement track is formed on said connecting portion said base may further comprising a plurality of elastic members mounted on said connecting portion of said base on two sides of said engagement track respectively, said elastic members having predetermined elasticity for biasing against said illuminating element.

17. The ceramic socket arrangement, as recited in claim 16, wherein said base further has a plurality of receiving grooves formed on two sides of said engagement track so that each of said receiving grooves is bounded by a corresponding inner surface of said corresponding sidewall and a corresponding side boundary of said engagement track, said elastic elements being received in said receiving grooves respectively.

18. The ceramic socket arrangement, as recited in claim 17, wherein said base further comprise a plurality of sliding grooves formed along said inner surfaces of said sidewalls respectively for slidably engaging with said sliding members, said sliding grooves extending along a longitudinal direction of said base to define two securing portions as a lower boundary of said sliding grooves respectively.

19. The ceramic socket arrangement, as recited in claim 18, wherein said base further comprises a plurality of resilient terminals provided on said sliding portion, wherein each of said resilient terminals downwardly extends from said sliding portion to operatively engage with said sliding member, each of said resilient terminals comprising a thin metallic sheet forming a main resilient portion and a curved engagement portion extended from said main resilient portion to engage with said sliding member, said resilient terminals electrically connecting to said electrical arrangement.

20. The ceramic socket arrangement, as recited in claim 19, wherein said curved engagement portion outwardly extends from a bottom edge of said main resilient portion, said main resilient portions of said resilient terminals inclinedly extending from said sliding portion of said base in an outward direction so that each of said resilient terminals extends from said sliding portion toward said corresponding sidewall of said base, such that when said resilient terminals pivotally move with respect to said sliding portion, said curved engagement portions move along a transverse direction of said base.

21. The ceramic socket arrangement, as recited in claim 20, wherein said sliding member comprises a slider plate, a plurality of coupling members downwardly extended from said slider plate, and a plurality of guiding members upwardly extended from said slider plate at positions in front of said coupling members respectively.

22. The ceramic socket arrangement, as recited in claim 21, wherein said coupling members extend from two side edge portions of said sliding plate, each of said coupling members having a coupling groove indently formed from an outer side surface of said corresponding coupling member so as to form a coupling portion as an upper boundary of said coupling groove, said coupling member being arranged to slidably engage with said base in such a manner that said coupling portion is arranged to fittedly and slidably insert into said corresponding sliding groove while said securing portions of said base are arranged to fittedly and slidably inserted into said coupling grooves respectively.

23. The ceramic socket arrangement, as recited in claim 22, wherein each of said coupling members further has an inclined surface formed on a front portion thereof so that a perpendicular distance between said two coupling members may gradually increase from rear to front with respect to said front portion of said coupling member.

24. The ceramic socket arrangement, as recited in claim 23, wherein said sliding member further comprises a biasing member downwardly extended from said slider plate at a position between said coupling members for restriction a further forward movement of said slider plate.

25. The ceramic socket arrangement, as recited in claim 24, wherein said guiding members extend from said front portions of said coupling members toward said front edge of said slider plate, a perpendicular distance between said two guiding members gradually decreasing from said front portions of said coupling members toward said front edge of said slider plate, so that when said sliding member is in said locked position, said curved engagement portions are arranged to be fittedly received in a space between said coupling members.

* * * * *